US012342892B2

(12) United States Patent
Fumey

(10) Patent No.: US 12,342,892 B2
(45) Date of Patent: Jul. 1, 2025

(54) ADHESIVE CLIP FOR ATTACHING HEADBAND TO GRADUATION CAP

(71) Applicant: William Fumey, Clarksville, MD (US)

(72) Inventor: William Fumey, Clarksville, MD (US)

( * ) Notice: Subject to any disclaimer, the term of this patent is extended or adjusted under 35 U.S.C. 154(b) by 0 days.

(21) Appl. No.: 18/536,575

(22) Filed: Dec. 12, 2023

(65) Prior Publication Data

US 2025/0089833 A1 Mar. 20, 2025

Related U.S. Application Data

(60) Provisional application No. 63/539,001, filed on Sep. 18, 2023.

(51) Int. Cl.
*A42B 1/22* (2006.01)

(52) U.S. Cl.
CPC ..... *A42B 1/22* (2013.01)

(58) Field of Classification Search
CPC ..... A42B 1/22; A42B 1/242; A42B 1/205; A42B 7/00; A42B 1/004; A44B 11/02; A44B 11/06; A47B 2097/003; A45D 8/36; A45D 8/004; A45D 8/006; A41G 5/0093; A41D 27/08; A41D 20/00; A42C 3/04

See application file for complete search history.

(56) References Cited

U.S. PATENT DOCUMENTS 163,913 A * 6/1875 Blackwood ..... A42B 7/00 132/59
215,998 A * 5/1879 Waddell et al. ..... A42B 1/22 2/181.2
248,542 A * 10/1881 Wilson ..... A45D 8/12 132/275
275,670 A * 4/1883 Kendall ..... A42B 7/00 2/181.6
422,137 A * 2/1890 Massey ..... A42B 7/00 2/175.7
600,543 A * 3/1898 Martyn ..... A42B 7/00 132/63.1
612,796 A * 10/1898 Bliss ..... A42B 1/004 2/209.3
671,887 A * 4/1901 Huppertz ..... A42B 7/00 132/59
678,725 A * 7/1901 Gauen ..... A42B 7/00 132/59
753,314 A * 3/1904 Rickard ..... A42B 7/00 132/57.1
836,899 A * 11/1906 Smith ..... A42B 1/02 2/171.01

(Continued)

*Primary Examiner* — Heather Mangine
*Assistant Examiner* — Raquel M. Weis
(74) *Attorney, Agent, or Firm* — Dunlap Bennett & Ludwig, PLLC; Anna L. Kinney

(57) ABSTRACT

An attachment system for a graduation cap includes a headband and a securing assembly. The cap includes an inner upper surface. The headband is sized and shaped to be secured to the head of a person. The securing assembly, removably secured to the headband, includes a base, a spring clip, and adhesive material. The base includes an integral projection extending from a lateral side surface. The spring clip, unitary with the projection, is adapted for removably securing the base to the headband. The adhesive material, fixed to an upper surface of the base, is present in an amount effective for securing the base to the inner upper surface of a cap.

7 Claims, 5 Drawing Sheets

(56) References Cited

U.S. PATENT DOCUMENTS 1,283,686 A * 11/1918 Dahl ..... A42B 7/00 132/59
1,692,719 A * 11/1928 Busey ..... A42B 7/00 132/273
1,715,331 A * 5/1929 Richter ..... A45D 8/36 132/275
1,745,184 A * 1/1930 Myers ..... A42B 1/02 2/171.01
1,934,114 A * 11/1933 Brander ..... A42B 1/02 2/171.01
2,153,146 A * 4/1939 Holmes ..... A42B 1/02 2/171.01
2,248,497 A * 7/1941 Gelvin ..... A42B 1/02 2/200.3
2,289,370 A * 7/1942 Krag ..... A42B 1/02 2/171.01
2,629,874 A * 2/1953 La Maida ..... A42B 1/02 2/209.3
2,849,007 A * 8/1958 Behr ..... A45D 8/36 132/148
3,134,107 A * 5/1964 Kelly ..... A42B 1/02 2/200.3
3,211,160 A * 10/1965 Miller ..... A45D 8/36 132/275
4,936,699 A * 6/1990 Yoshida ..... A63H 33/00 63/11
5,027,992 A * 7/1991 Murray, III ..... G09F 21/02 D2/869
5,427,123 A * 6/1995 Odenthal ..... A45D 8/36 132/275
5,829,457 A * 11/1998 Huang ..... A45C 13/08 63/3
5,857,469 A * 1/1999 Sowell ..... A45D 8/24 132/278
5,901,381 A * 5/1999 Nelson ..... A41D 20/00 2/244
5,913,316 A * 6/1999 Chou ..... A45D 8/36 132/273
5,934,294 A * 8/1999 Chiang ..... A45D 8/006 63/15
5,975,092 A * 11/1999 Tsai ..... A45D 8/20 132/273
6,024,102 A * 2/2000 Huang ..... A45D 8/36 132/273
6,049,912 A * 4/2000 Linehan ..... G09F 21/02 2/244
6,237,611 B1 * 5/2001 LeCrone ..... A42B 1/24 132/275
6,357,052 B1 * 3/2002 Fleming ..... A42B 1/004 2/244
6,513,167 B1 * 2/2003 Cheng ..... A45D 8/36 2/209.13
6,688,316 B1 * 2/2004 Klug ..... A45D 8/002 211/13.1
9,241,526 B2 * 1/2016 Goldberg ..... A42B 1/248
9,936,753 B2 * 4/2018 Yeh ..... A41G 7/00
D820,519 S * 6/2018 Templer ..... D2/866
D852,464 S * 7/2019 Kirschner ..... D2/882
D855,292 S * 8/2019 Robinson ..... D2/866
10,945,474 B2 * 3/2021 Atkinson-Skinner .... A45D 8/36
2003/0121127 A1 * 7/2003 Walker ..... A41D 20/00 24/306
2003/0221242 A1 * 12/2003 Yeh ..... A42B 7/00 132/273
2005/0056298 A1 * 3/2005 McRoberts ..... A45D 8/34 132/276
2008/0202548 A1 * 8/2008 Fala ..... A45D 8/36 132/273
2009/0032044 A1 * 2/2009 Grimm ..... A45D 8/12 132/273
2010/0277944 A1 * 11/2010 Hurwitz ..... A45D 8/36 2/244
2011/0146701 A1 * 6/2011 Chou ..... A45D 8/36 132/275
2012/0118317 A1 * 5/2012 Payne ..... A45D 8/006 132/275
2012/0246800 A1 * 10/2012 Liu ..... A45D 8/36 2/209.13
2014/0083444 A1 * 3/2014 Grimm ..... A45D 8/12 132/148
2014/0130819 A1 * 5/2014 Karam ..... A41G 5/0093 132/54
2016/0073757 A1 * 3/2016 Beckerman ..... A45D 8/36 132/200
2017/0049174 A1 * 2/2017 Holcomb ..... A42B 1/004
2017/0099928 A1 * 4/2017 Krebsbach ..... A43B 23/24
2018/0020798 A1 * 1/2018 Gjertsen ..... A45D 8/34 132/275
2022/0295936 A1 * 9/2022 Wright ..... A42B 7/00
2025/0089833 A1 * 3/2025 Fumey ..... A42B 1/22
2025/0089839 A1 * 3/2025 Fumey ..... A42B 1/02

* cited by examiner

ADHESIVE CLIP FOR ATTACHING HEADBAND TO GRADUATION CAP

REFERENCE TO RELATED APPLICATION

This nonprovisional patent application is based on provisional patent application U.S. Ser. No. 63/539,001 filed Sep. 18, 2023, hereby incorporated by reference in its entirety for purposes of priority pursuant to Title 35, United States Code, Section 120.

FIELD

The present subject matter is directed, in general, to graduation caps and, more particularly, is directed to an adhesive clip for attaching a headband to a graduation cap.

BACKGROUND

While graduation ceremonies from, e.g., high schools, colleges, and universities are typically celebrations of joy, pomp, and achievement, keeping a graduation cap firmly on one's head, for certain individuals, can be problematic. Graduation caps, also called "mortar boards"—academic caps with a square, flat, horizontal topside—have remained unchanged for countless generations. Typically, mortar boards are only available in small, medium, and large sizes. Limited cap size and minimal structure to secure a cap to a wearer's head, are problems thwarting firmly keeping graduation caps on graduate heads.

Kinky and curly hair, together with voluminous hair styles, are additional problems a mortar board wearer must overcome to firmly secure a mortar board to a wearer's head.

A typical mortar board includes a square-shaped generally planar topside, to which is fixed a crown, and across a predetermined side of which a tassel may lay. The crown is used to firmly secure a mortar board atop a graduate's head. The topside and crown each consist of inner layers of rather stiff material enclosed by high quality cloth material.

One or more elongated pins (formerly called "hat pins"), when used to firmly secure mortar boards to a wearer's head, will produce tiny holes and thus damage mortar boards.

Many graduates rent mortar boards, so damaging them is undesirable. Moreover, modifying mortar boards in ways that assure they remain on a wearer's head can be time consuming, expensive, or otherwise problematic, since many modifications made directly to a mortar board may require an expert to do them by hand. There is, therefore, a need in this field for a graduation cap modification system that allows for easy and convenient modification to graduation caps without damaging the graduation caps. In the detailed description below, these and other features and advantages of the present subject matter will be described in detail and made clear to a person of ordinary skill in the art (POSITA).

An embodiment of the present subject matter, solving many of the problems noted, shall now be summarized as a currently contemplated "best mode" of the present subject matter, which is not presented in a limiting sense but rather for illustrating the principles of the present subject matter, with its patent scope being set forth in the appended claims.

SUMMARY

The present subject matter is directed to an attachment system for a graduation cap. The cap includes a crown and a square flat top fixed to the crown. The crown is sized and shaped to fit upon the head of a person wearing the graduation cap. The attachment system includes a headband and a securing assembly. The headband is sized and shaped to be secured to the head of a person. The securing assembly is removably secured to the headband. The securing assembly includes a base, a spring clip, and adhesive material. The base includes a pair of spaced-apart upper and lower surfaces and a lateral side surface unitary with the upper and lower surfaces. A portion of the lateral side surface includes an integral projection extending from the lateral side surface. The spring clip, unitary with the integral projection, is adapted and configured to removably secure the headband to the lower surface of the base. The adhesive material is fixed to the upper surface of the base. The graduation cap includes an inner upper surface. The adhesive material includes an adhesive composition present in an amount effective for removably securing the adhesive material to an inner upper surface of a graduation cap. In some embodiments, the base and spring clip have a monolithic construction.

Figure 1:
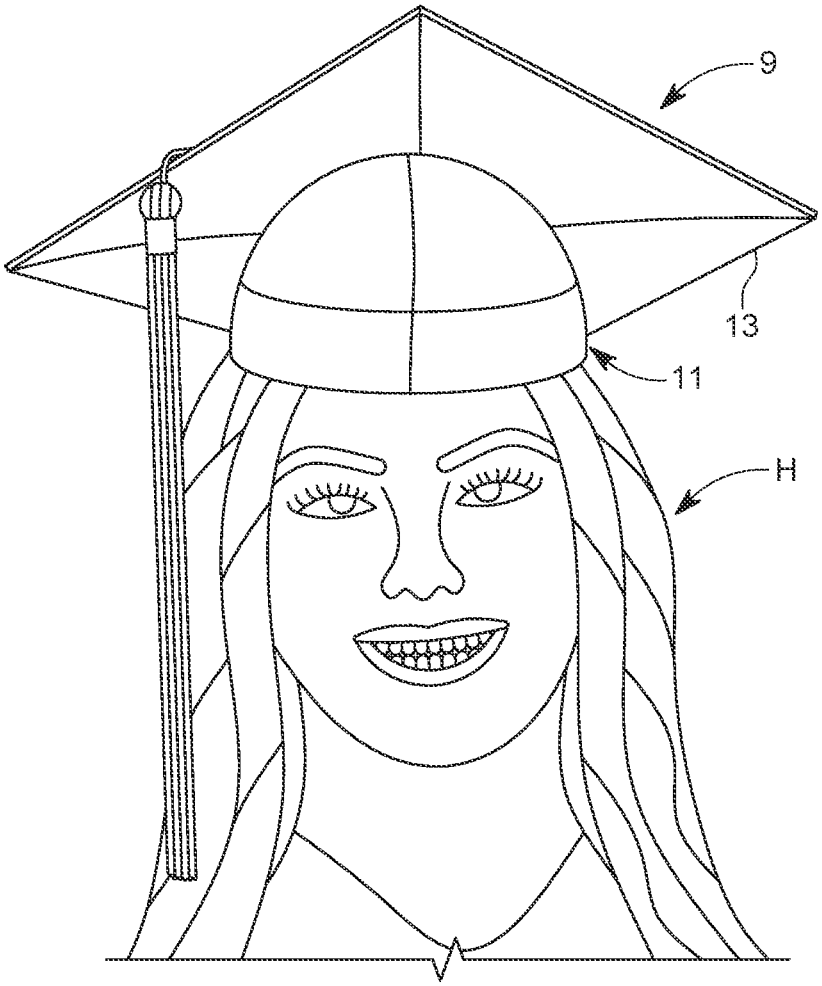
FIG. 1 depicts a person wearing the present subject matter secured to such a cap.

Throughout the drawing figures and the detailed description, similar alphanumeric references shall be used to refer to features of the present subject matter that are similar.

DETAILED DESCRIPTION

In a broad sense, the present subject matter is directed to a headwear modification system for modifying conventional headwear to be wearable by wearers having curly hair, voluminous, or otherwise challenging hair, for wearing headwear in its standard manner.

Figure 2:
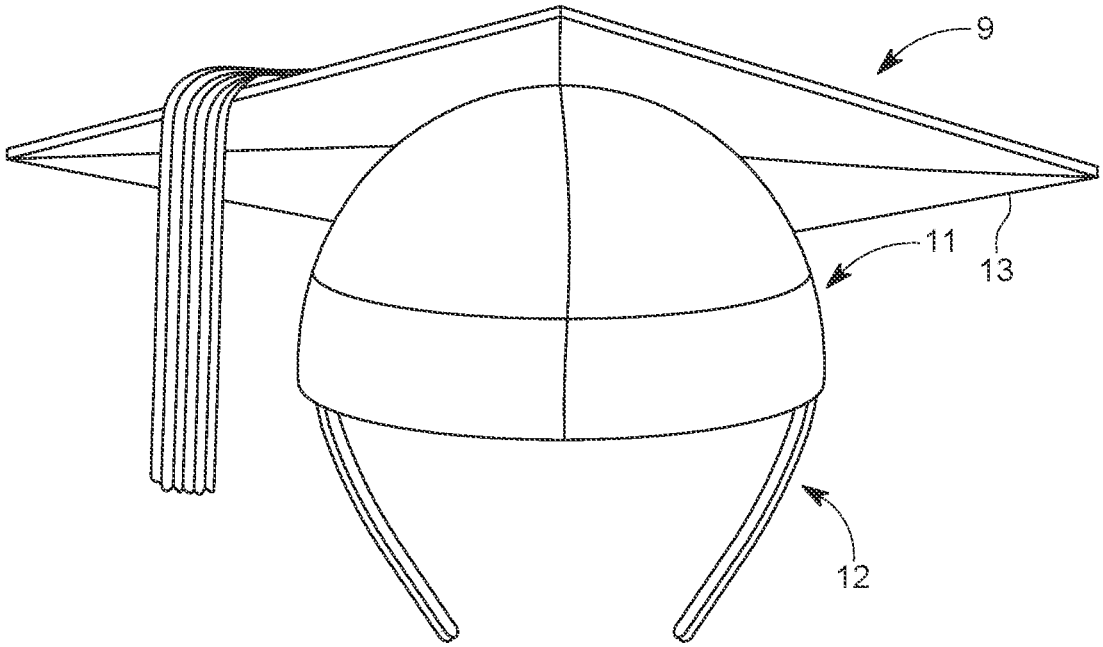
FIG. 2 depicts a graduation cap and a headband (hidden by wearer hair in FIG. 1).
Figure 3:
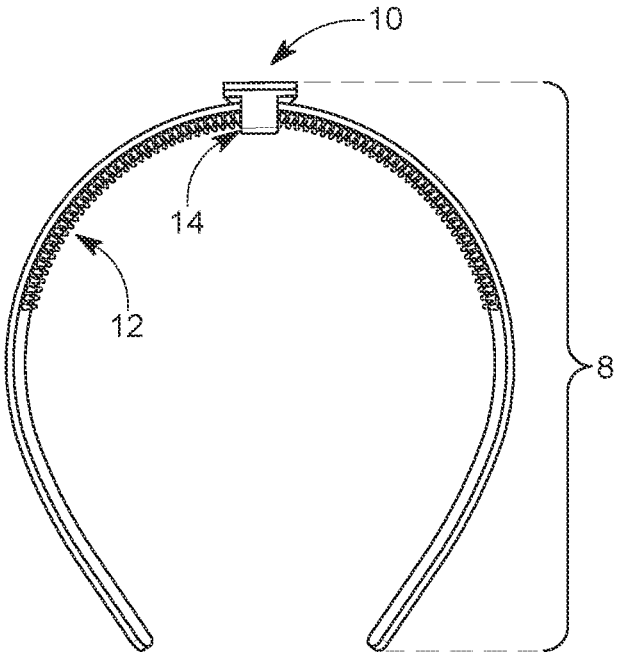
FIG. 3 is an embodiment of the attachment system of the present subject matter.
Figure 7:
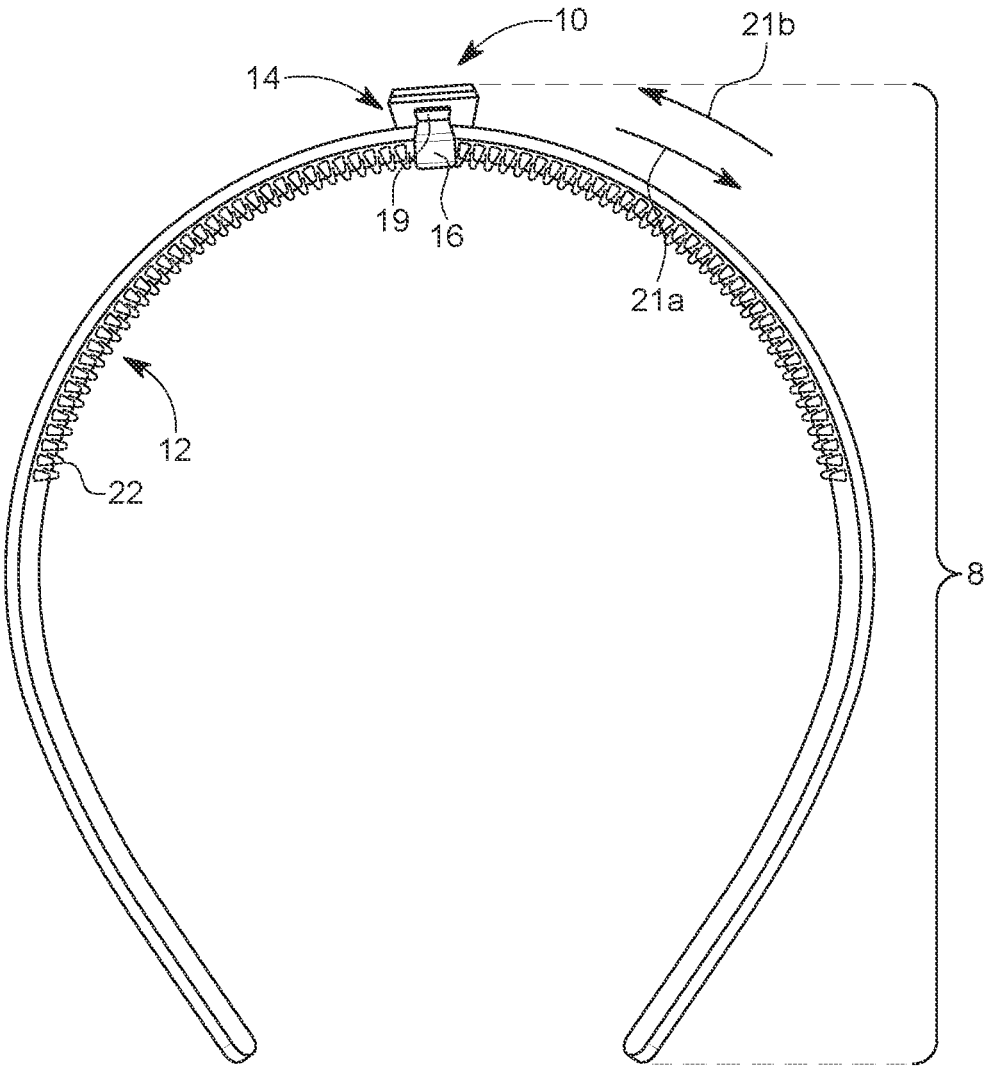
FIG. 7 shows the backside of the headband shown in FIG. 3, on an enlarged scale.

The present subject matter is directed to a current embodiment of an attachment system 8 (FIGS. 3, 7) for a mortar board or graduation cap 9. (See FIGS. 1, 2, and 4.) The mortar board or graduation cap 9 includes a crown 11 (FIGS. 1, 2, and 4) and a square, flat top 13 (FIGS. 1, 2, 4) securely fixed to the crown 11. The crown 11 is dimensioned and configured to fit neatly upon the head H (FIG. 1) of a person wearing the graduation cap 9. The attachment system 8 comprises a headband 12 and a securing assembly 10. The headband 12 is sized and shaped to be neatly removably secured to a person's head H (see FIGS. 1, 2). The securing assembly 10 is removably secured to the headband 12.

Figure 5:
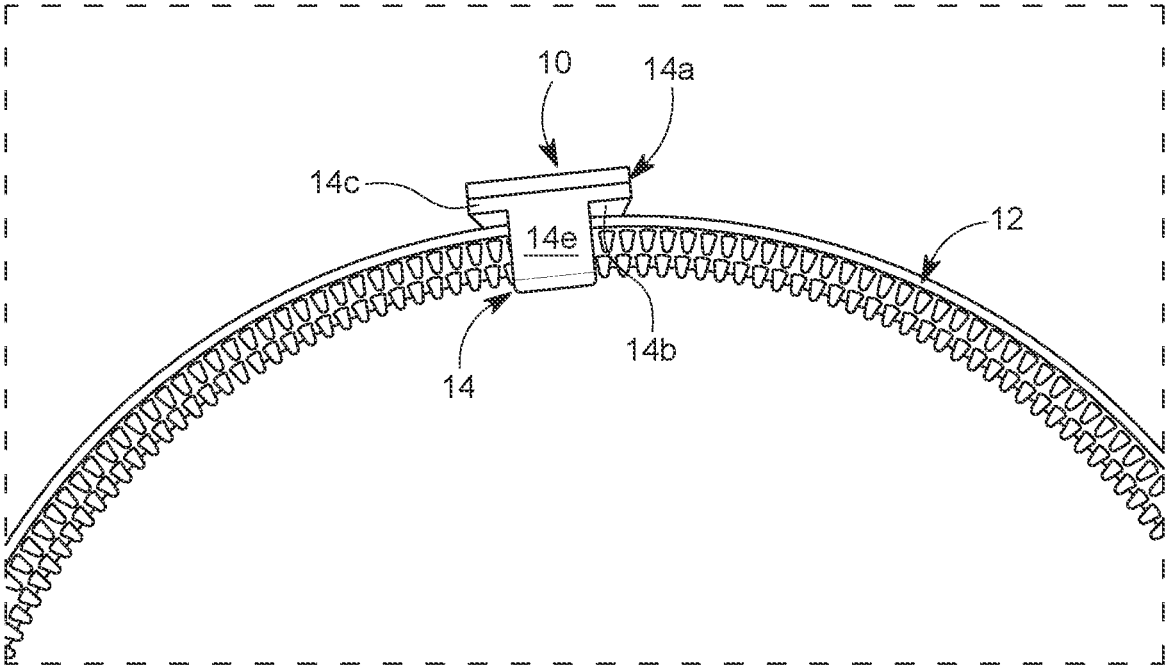
FIG. 5 depicts a portion of the headband, tilted to show certain spring clip features.
Figure 6:
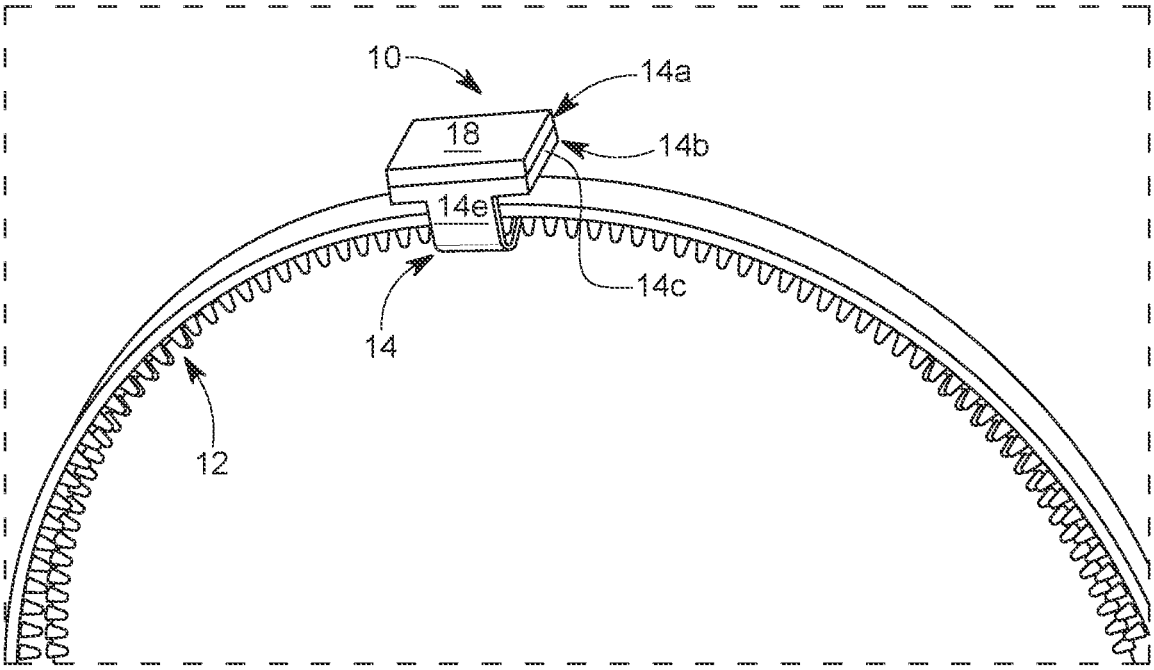
FIG. 6 depicts a portion of the headband, tilted to show other spring clip features.

The securing assembly 10 includes a base 14 (FIG. 3-7), a spring clip 16 (FIG. 7), and an adhesive material 18 (FIG. 6). The base defines a pair of spaced-apart upper and lower surfaces 14*a* and 14*b* (FIGS. 5, 6) and a lateral side surface 14*c* (FIGS. 5, 6) unitary with the upper and lower surfaces

14*a* and 14*b*. A portion of the lateral side surface 14*c* includes an integral projection 14*e* (FIG. 5) extending from the lateral side surface 14*c*.

Adhesive material 18, secured to base 14, is more particularly secured to the upper surface 14*a* of the base 14 (FIG. 6). Spring clip 16 (FIG. 7) is unitary with projection 14*e* (FIGS. 5, 6). Spring clip 16 is adapted and configured to removably secure headband 12 and base 14 together. For instance, spring clip 16 is made of a springy and durable plastic or composite material or a springy noncorrosive metal or metal alloy. In addition, the spring clip 16 is sized, adapted, and configured to removably secure an external surface portion of headband 12 to the lower surface 14*b* of base 14. A tab 19 (FIGS. 4, 7), unitary with the spring clip 16, enables a user to release the spring clip 16 from projections 22 on the headband 12 to enable the base 14 to be moved in a first direction 21*a* or in a second direction 21*b* (opposite the first direction 21*a*) relative to the headband 12. (See FIG. 7.)

Figure 4:
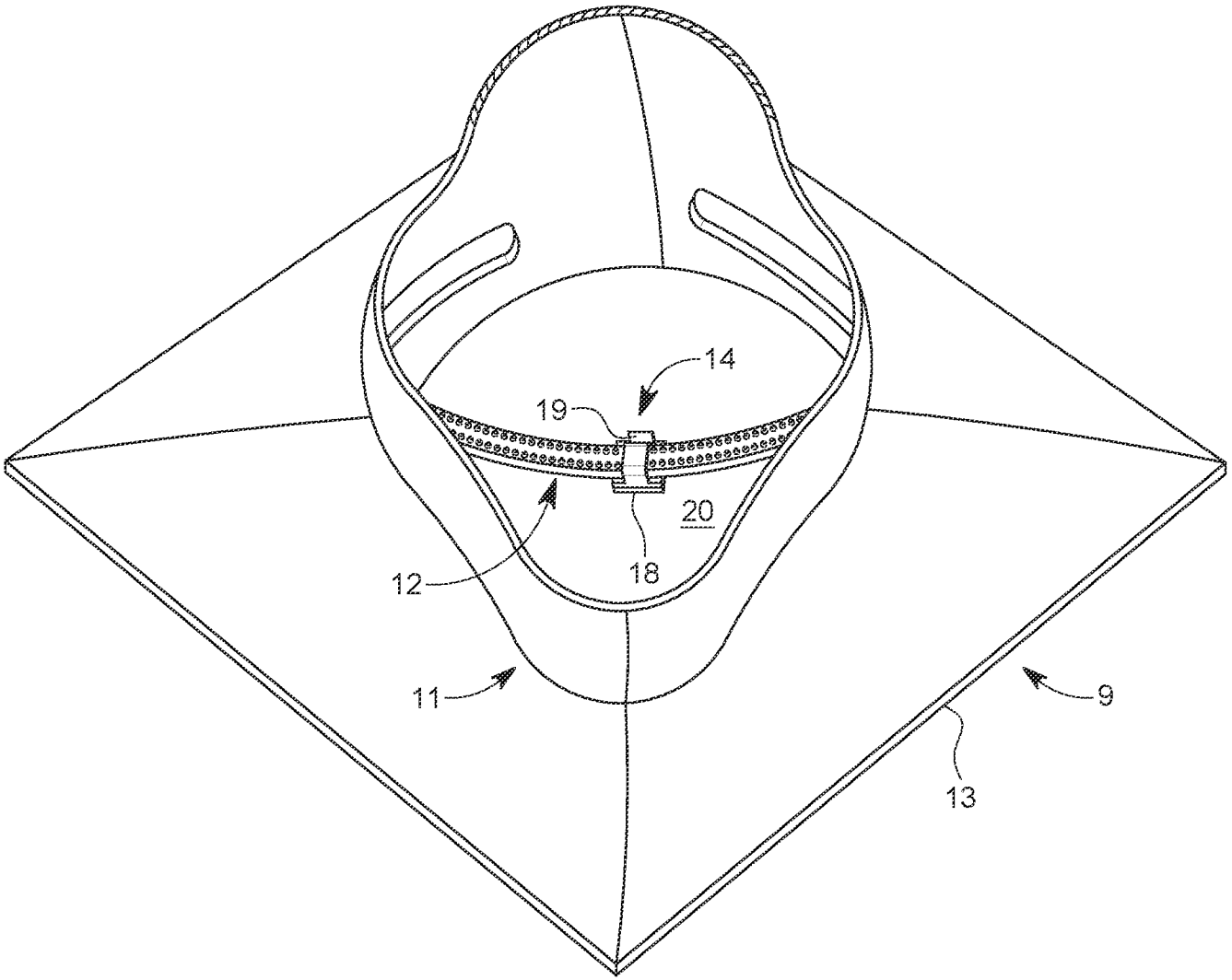
FIG. 4 presents an underside view of a graduation cap, with a component of the attachment system being shown removably secured to an inner upper surface of the cap.

Graduation cap 9 has an inner upper surface 20 (FIG. 4). Adhesive material 18 includes an adhesive composition present in an amount effective for removably securing the adhesive material 18 to an inner upper surface 20 of graduation cap 9. Examples of adhesive compositions suitable for making the adhesive material 18 of the present subject matter include wood glue, elastomers, silicone sealants, and pressure sensitive materials.

Illustrated and described in this patent specification is an attachment system for a graduation cap (or "mortar board"). While the present subject matter is described with reference to an exemplary embodiment, the present subject matter is not limited to this embodiment (of the attachment system) described herein. On the contrary, alternatives, changes, and/or modifications shall become apparent to a person of ordinary skill in the art ("POSITA") after this specification is read and its figures reviewed. Therefore, all alternatives, changes, and modifications are to be treated as forming a part of the present subject matter insofar as they fall within the spirit and the scope of the appended claims.

I claim:

1. An attachment system for a graduation cap comprising:

the graduation cap that includes a crown and a square flat top fixed to the crown, wherein the crown is sized and shaped to fit upon the head of a person wearing the graduation cap, wherein the attachment system comprises:

a headband, the headband having a first end and a second end and an elongated arcuate body extending continuously from the first end to the second end, the headband having projections extending from a concave surface of the elongated arcuate body, and the headband sized and shaped to be secured to a person's head; and a unitary securing device secured to the headband, wherein the unitary securing device comprises:

a base, the base defining a pair of spaced-apart upper and lower surfaces and a lateral side surface unitary with the pair of spaced-apart upper and lower surfaces; and the base having a substantial T-shape with a stem and an arm, wherein the stem is formed by the lateral side surface and the arm is formed by the base; and wherein a portion of the lateral side surface includes an integral projection extending from the lateral side surface; and the lateral side surface further comprises a spring clip unitary with the integral projection, and the spring clip is adapted and configured to removably secure the headband and the base together; and the spring clip further comprises a tab, the tab being unitary with the spring clip and operative to release the spring clip from the headband, and wherein the base further comprises an adhesive material fixed to the upper surface of the base, wherein the graduation cap defines an inner upper surface, and wherein the adhesive material includes an adhesive composition present in an amount effective for removably securing the adhesive material to the inner upper surface of the graduation cap.

2. The attachment system of claim 1, wherein the spring clip is sized, adapted, and configured to removably secure an external surface portion of the headband to the lower surface of the base.

3. The attachment system of claim 2, wherein the spring clip is made of a durable plastic, a composite material, a noncorrosive metal, or a metal alloy.

4. The attachment system of claim 1, wherein the unitary securing device is movable along the headband in a first direction and in a second direction opposite the first direction.

5. The attachment system of claim 1, wherein the adhesive composition is selected from the group consisting of wood glue, elastomers, silicone sealants, and pressure sensitive materials.

6. The attachment system of claim 1, wherein the unitary securing device is positioned midway along the elongated arcuate body.

7. The attachment system of claim 1, wherein, when in a use position, the adhesive material secures the upper surface of the base to the inner upper surface of the graduation cap.

* * * * *